US007862132B2

(12) United States Patent
Tynes et al.

(10) Patent No.: US 7,862,132 B2
(45) Date of Patent: Jan. 4, 2011

(54) COUNTERBALANCE ASSEMBLY FOR A DISHWASHER DOOR AND ASSOCIATED METHOD

(75) Inventors: Ronald G. Tynes, Winterville, NC (US); Daniel M. Stewart, Kinston, NC (US); John Helgesen, Rock Hill, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 283 days.

(21) Appl. No.: 11/869,911

(22) Filed: Oct. 10, 2007

(65) Prior Publication Data

US 2008/0272678 A1 Nov. 6, 2008

Related U.S. Application Data

(60) Provisional application No. 60/916,013, filed on May 4, 2007.

(51) Int. Cl.
*A47B 88/00* (2006.01)

(52) U.S. Cl. ..... 312/328; 312/319.2; 312/228

(58) Field of Classification Search ... 312/319.2–319.4, 312/327, 328, 311, 228; 68/3 R, 196; 16/78, 16/81, 72, 286; 49/386, 387; 474/1, 58, 474/62

See application file for complete search history.

(56) References Cited

U.S. PATENT DOCUMENTS

| | | | | | |
|---|---|---|---|---|---|
| 1,963,388 | A | * | 6/1934 | Smith | 126/194 |
| 2,237,795 | A | * | 4/1941 | Shroyer | 126/19 R |
| 2,553,439 | A | * | 5/1951 | Carmichael | 474/62 |
| 2,833,270 | A | * | 5/1958 | Brown et al. | 126/191 |
| 3,049,114 | A | | 8/1962 | Carnahan et al. | |
| 3,288,154 | A | | 11/1966 | Jacobs | |
| 3,466,105 | A | | 9/1969 | Guth | |
| 3,820,866 | A | | 6/1974 | Kaldenberg | |
| 3,837,119 | A | * | 9/1974 | Conneally et al. | 49/404 |
| 3,978,617 | A | * | 9/1976 | Eventoff | 49/404 |
| 4,887,393 | A | * | 12/1989 | Cysewski | 49/385 |
| 4,898,493 | A | * | 2/1990 | Blankenburg | 403/326 |
| 5,226,706 | A | | 7/1993 | Tuller | |
| 5,452,184 | A | * | 9/1995 | Scholder et al. | 361/799 |
| 5,546,632 | A | * | 8/1996 | Robinson et al. | 16/54 |
| 5,980,006 | A | | 11/1999 | Wilhelmstatter et al. | |
| 5,988,933 | A | | 11/1999 | Wilhelmstatter et al. | |
| 6,467,128 | B1 | * | 10/2002 | Damani | 16/197 |
| 6,505,381 | B1 | * | 1/2003 | Thomson et al. | 16/302 |
| 6,557,958 | B1 | | 5/2003 | Motta et al. | |
| 7,472,457 | B2 | * | 1/2009 | Giovannetti | 16/78 |
| 2004/0113531 | A1 | | 6/2004 | Raches | |
| 2008/0122331 | A1 | * | 5/2008 | Haeberle | 312/319.1 |

* cited by examiner

*Primary Examiner*—Janet M Wilkens
*Assistant Examiner*—Dan Rohrhoff
(74) *Attorney, Agent, or Firm*—Alston & Bird LLP

(57) ABSTRACT

A dishwasher is provided, comprising a door pivotably attached to a body and having a counterbalance assembly coupled therebetween for facilitating pivoting of the door, wherein the counterbalance assembly includes a biasing member coupled to the body and serially engaged with a flexible element coupled to the door, and a guide member secured to the body and including a fixed arcuate member defining a first guide track, and a pulley rotatable about an axis and defining a second guide track, wherein the flexible element is at least partially wrapped about each of the fixed arcuate member and the pulley so as to serially engage the first and second guide tracks, and wherein the first guide track of the fixed arcuate member is offset from the second guide track of the pulley along the axis thereof.

17 Claims, 10 Drawing Sheets

COUNTERBALANCE ASSEMBLY FOR A DISHWASHER DOOR AND ASSOCIATED METHOD

CROSS REFERENCE TO RELATED APPLICATIONS

The present application claims priority from U.S. Provisional Application No. 60/916,013 entitled "Counterbalance Assembly for a Dishwasher Door and Associated Method" filed May 4, 2007, the contents of which are incorporated herein by reference.

BACKGROUND OF THE INVENTION

1. Field of the Invention

Embodiments of the present invention relate to dishwashers and, more particularly, to a counterbalance assembly for a dishwasher door, and a method associated therewith.

2. Description of Related Art

A dishwasher typically includes a wash tub for containing the dishware to be washed, wherein the tub defines a front opening. The front opening is configured to be engaged by a door for closing/sealing the front opening. The door is typically hinged at the lower end thereof such that the upper end of the door can be pivoted downward so as to permit access to the interior of the tub.

The dishwasher may include a device for balancing or counterbalancing the weight of the door, when opening and closing the door. For example, U.S. Pat. No. 5,226,706 to Tuller discloses an adjustable door balancing mechanism that includes a counterbalance spring. The counterbalance spring extends between the door and an adjustable bracket mounted to the tub support. The tension in the counterbalance spring may be varied by changing the position of the adjustable bracket.

Despite these improvements in counterbalancing a dishwasher door, it would be advantageous for the door of the dishwasher to be balanced or counterbalanced so as to allow for smooth opening and closing of the door. That is, it may be advantageous to configure the door so as to prevent the door from inadvertently pivoting to the open or closed positions and/or to allow for the door to be maintained at various positions between the open and closed positions.

Therefore, it would be desirable to provide a counterbalance assembly that facilitates opening and closing of a dishwasher door. In addition, it may be desirable to provide a counterbalance assembly that may be easily integrated with a dishwasher, is cost efficient, and may be readily adjusted.

BRIEF SUMMARY OF THE INVENTION

The above and other needs may be met by embodiments of the present invention which, in one embodiment, provides a dishwasher comprising a door pivotably attached to a body and having a counterbalance assembly coupled therebetween for facilitating pivoting of the door. The counterbalance assembly includes a biasing member coupled to the body and serially engaged with a flexible element coupled to the door, and a guide member secured to the body and including a fixed arcuate member defining a first guide track and a pulley rotatable about an axis and defining a second guide track. The flexible element is at least partially wrapped about each of the fixed arcuate member and the pulley so as to serially engage the first and second guide tracks, wherein the first guide track of the fixed arcuate member is offset from the second guide track of the pulley along the axis thereof.

Another aspect of the present invention comprises a method for facilitating pivoting of a door with respect to a body of a dishwasher. The method includes coupling a biasing member to the body, serially engaging the biasing member with a flexible element, and coupling the flexible element to the door. In addition, the method includes securing a guide member to the body, wherein the guide member includes a fixed arcuate member defining a first guide track and a pulley rotatable about an axis and defining a second guide track. The method further includes wrapping the flexible element at least partially about each of the fixed arcuate member and the pulley so as to serially engage the first and second guide tracks, wherein the first guide track of the fixed arcuate member is offset from the second guide track of the pulley along the axis thereof.

Aspects of the present invention may provide significant advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
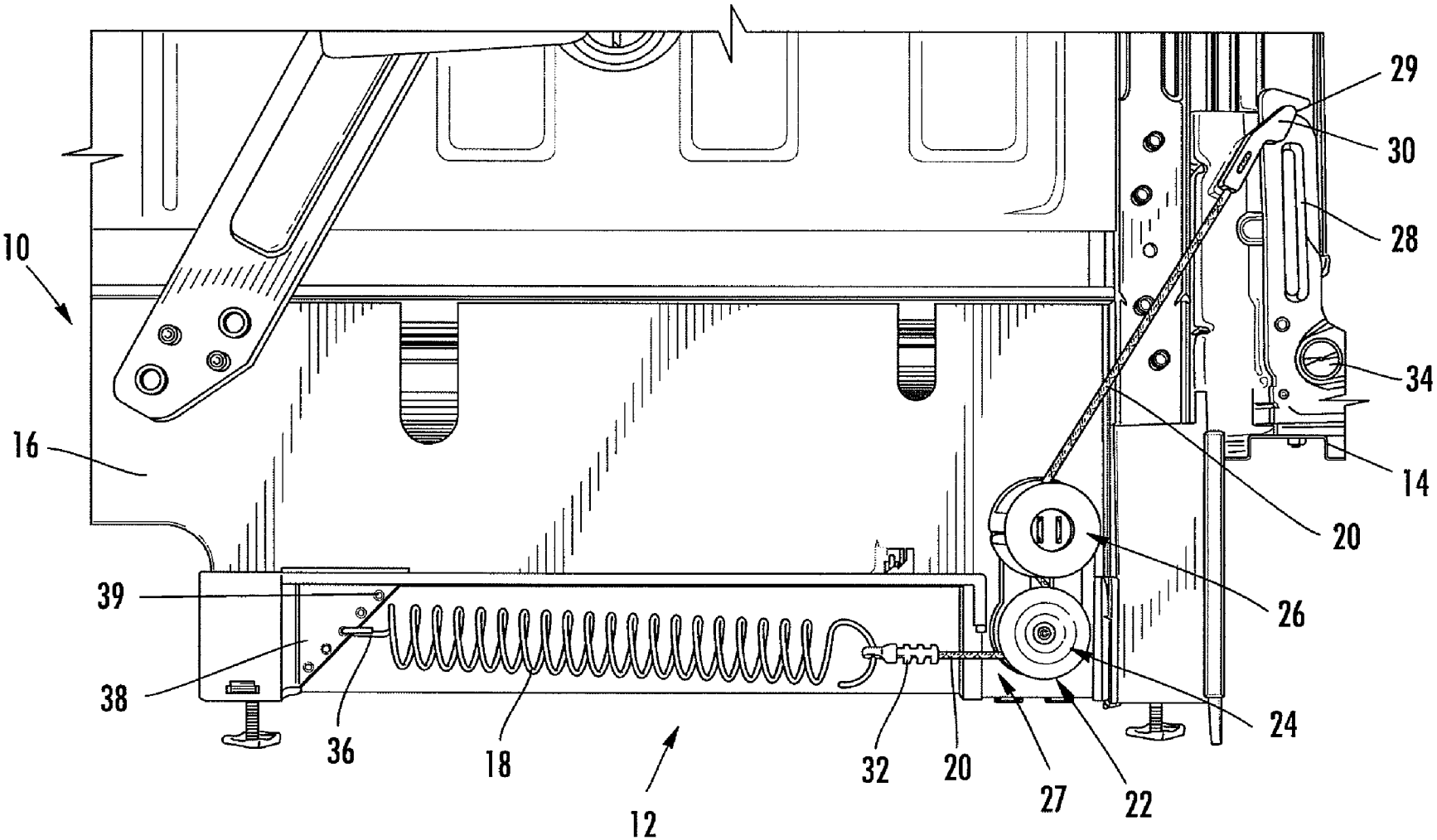
FIG. 1 illustrates a partial view of a dishwasher including a door counterbalance assembly, with a dishwasher door in an open position, according to one embodiment of the present invention.
Figure 2:
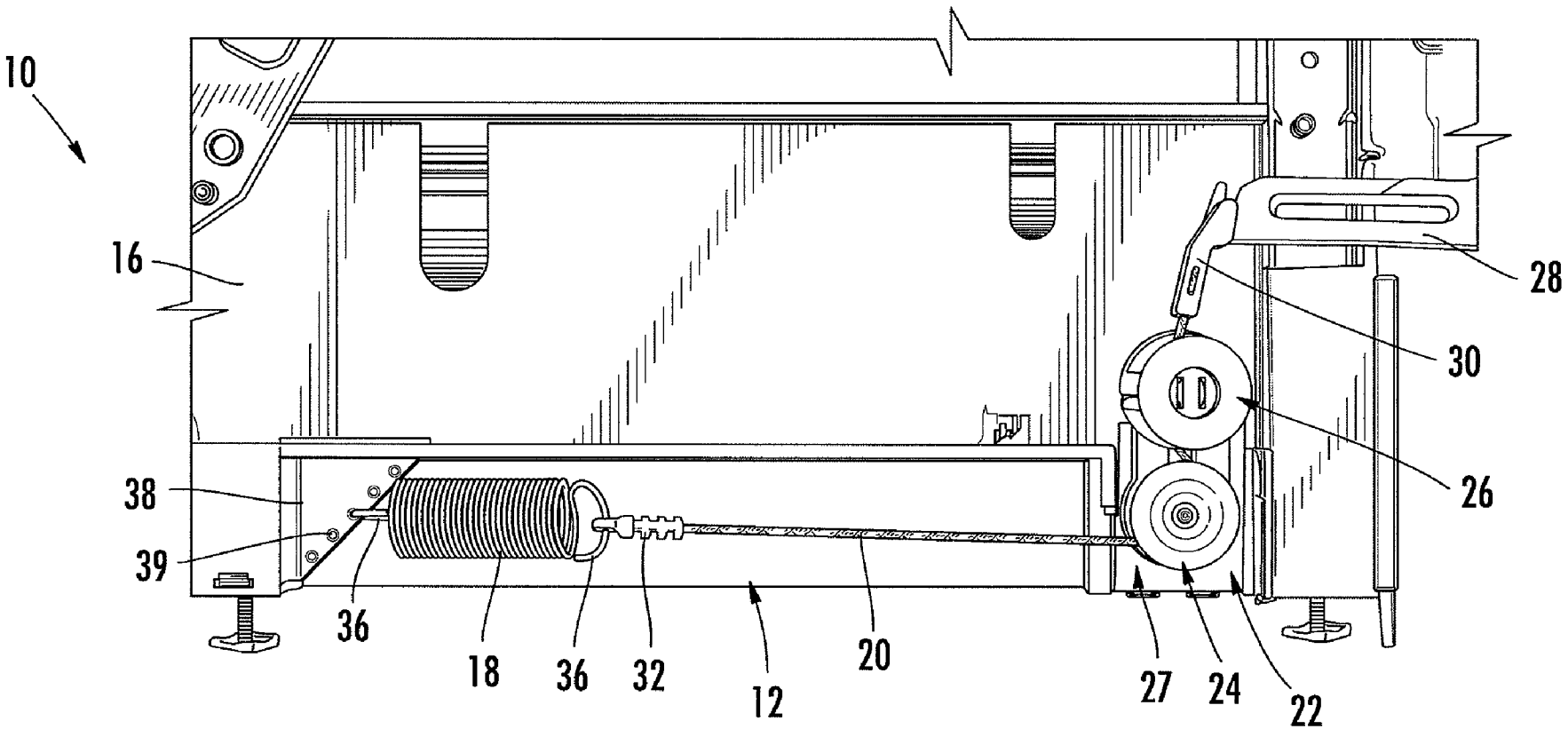
FIG. 2 illustrates the counterbalance assembly of FIG. 1 with the dishwasher door in a closed position.

FIGS. 1 and 2 illustrate a dishwasher 10 including a counterbalance assembly 12 according to one embodiment of the present invention. As explained in further detail below, the counterbalance assembly 12 facilitates pivoting of a door 14 with respect to a body 16 of the dishwasher 10. In general, the counterbalance assembly 12 includes a biasing member 18, a flexible element 20, and a guide member 22 which cooperate to allow the door 14 to be smoothly pivoted between open and closed positions, as well as to be maintained in various positions between the open and closed positions.

Although reference is made herein to a dishwasher 10, it is understood that the counterbalance assembly 12 is adapted to be used with other devices where pivoting between a door and a body is necessary. For example, the counterbalance assembly 12 may be used with other kitchen appliances, such as a stove. In addition, although only one counterbalance assembly 12 is shown in FIGS. 1 and 2, it is understood that there may be a counterbalance assembly on both sides of the dishwasher 10.

As shown in FIGS. 1 and 2, the counterbalance assembly 12 includes a biasing member 18, such as a tension spring or other elastic member made of a memory material. One end of the biasing member 18 is attached to a bracket 38. In one embodiment, the biasing member 18 includes a hook 36 at its free end that is sized and configured to be positioned within one of a plurality of holes 39 defined in the bracket 38. The bracket 38 is attached to the body 16 and, by positioning the hook 36 in different holes 39, the tension on the biasing member 18 may be adjusted.

Figure 3:
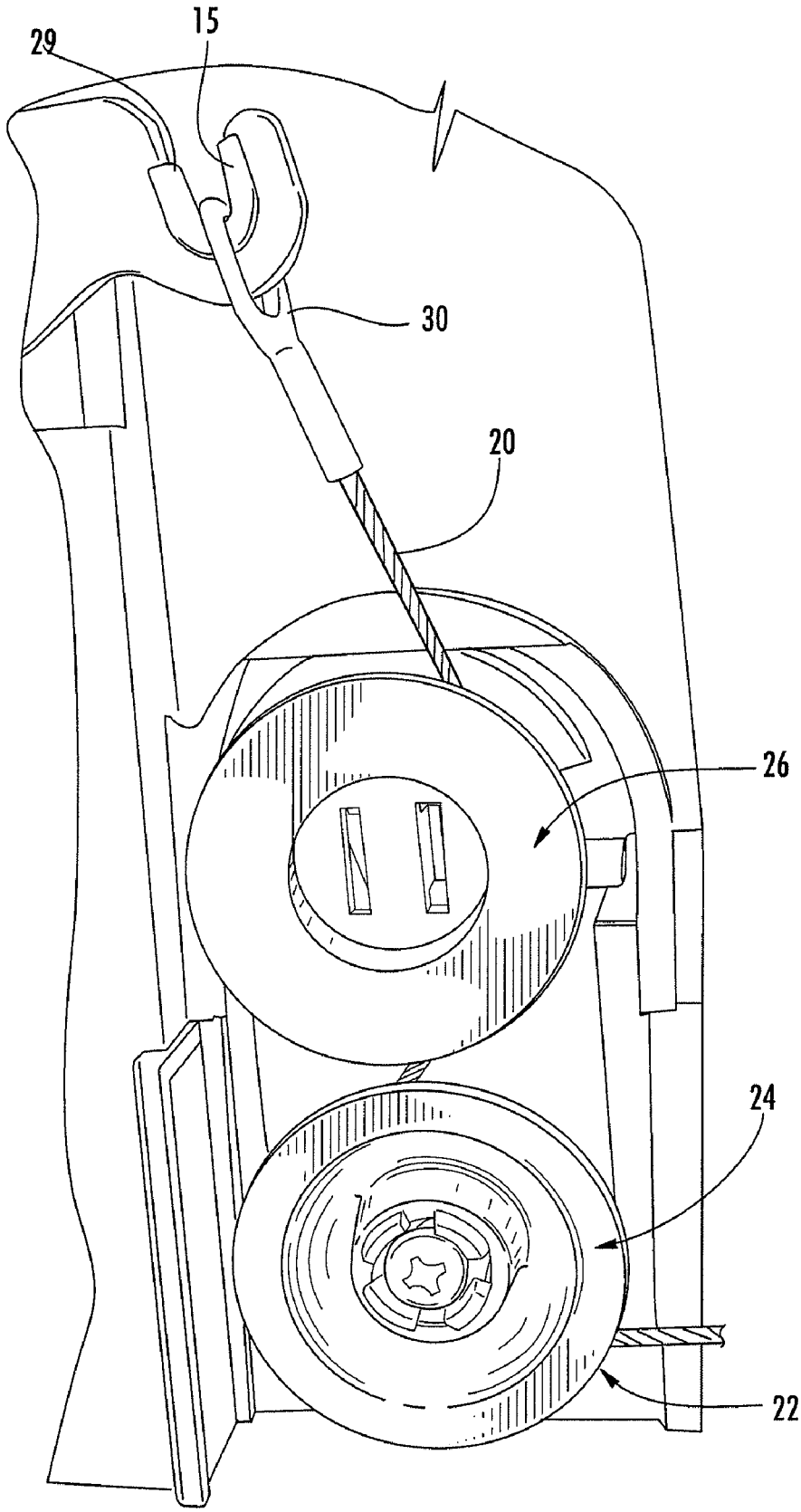
FIG. 3 is an enlarged view of the guide member shown in FIG. 1.

The opposite end of the biasing member 18 is coupled to a flexible element 20. In this regard, the biasing member 18 may include a hook 36 at its free end that is coupled to a coupling member 32 secured to one end of the flexible element 20. Thus, the coupling member 32 may include a hole sized and configured to receive the hook 36 of the biasing member 18. The opposite end of the flexible element 20 is coupled to a hinge bracket 28 with a coupling member 30. In one embodiment, the coupling member 30 is configured to be positioned within a slot 29 defined in the hinge bracket 28. The flexible element 20 may be, for example, an inelastic cord, such as a braided material. However, the flexible element 20 may be comprised of other materials, including elastic materials, capable of maintaining tension between the biasing member 18 and the hinge bracket 28 to facilitate opening and closing of the door 14. FIG. 3 illustrates that the slot 29 may include a bushing 15 and that the coupling member 30 may engage the slot and bushing. The bushing 15 may be a non-metallic material (e.g., polymeric) and may reduce squealing between the coupling member 30 and the slot 29 when the door 14 is opened and closed. The bushing 15 may correspond to the shape of the slot 29, such as be U-shaped as shown in FIG. 3.

The hinge bracket 28 and door 14 may pivot about a hinge pin 34. FIG. 1 illustrates the door 14 in an open position. Thus, in the open position, the portion of the hinge bracket 28 coupled to the flexible element 20 is generally vertically disposed, while the door 14 is generally horizontally disposed. The biasing member 18 is extended and, thus, tensioned from a relaxed position. FIG. 2 depicts the door 14 in a closed position. In the closed position, the hinge bracket 28 is generally horizontally disposed, while the door 14 is generally vertically disposed. Moreover, the biasing member 18 contracts to a relaxed position, while the length of the flexible element 20 between the guide member 22 and the hinge bracket 28 is shortened when compared to the open position.

Figure 4:
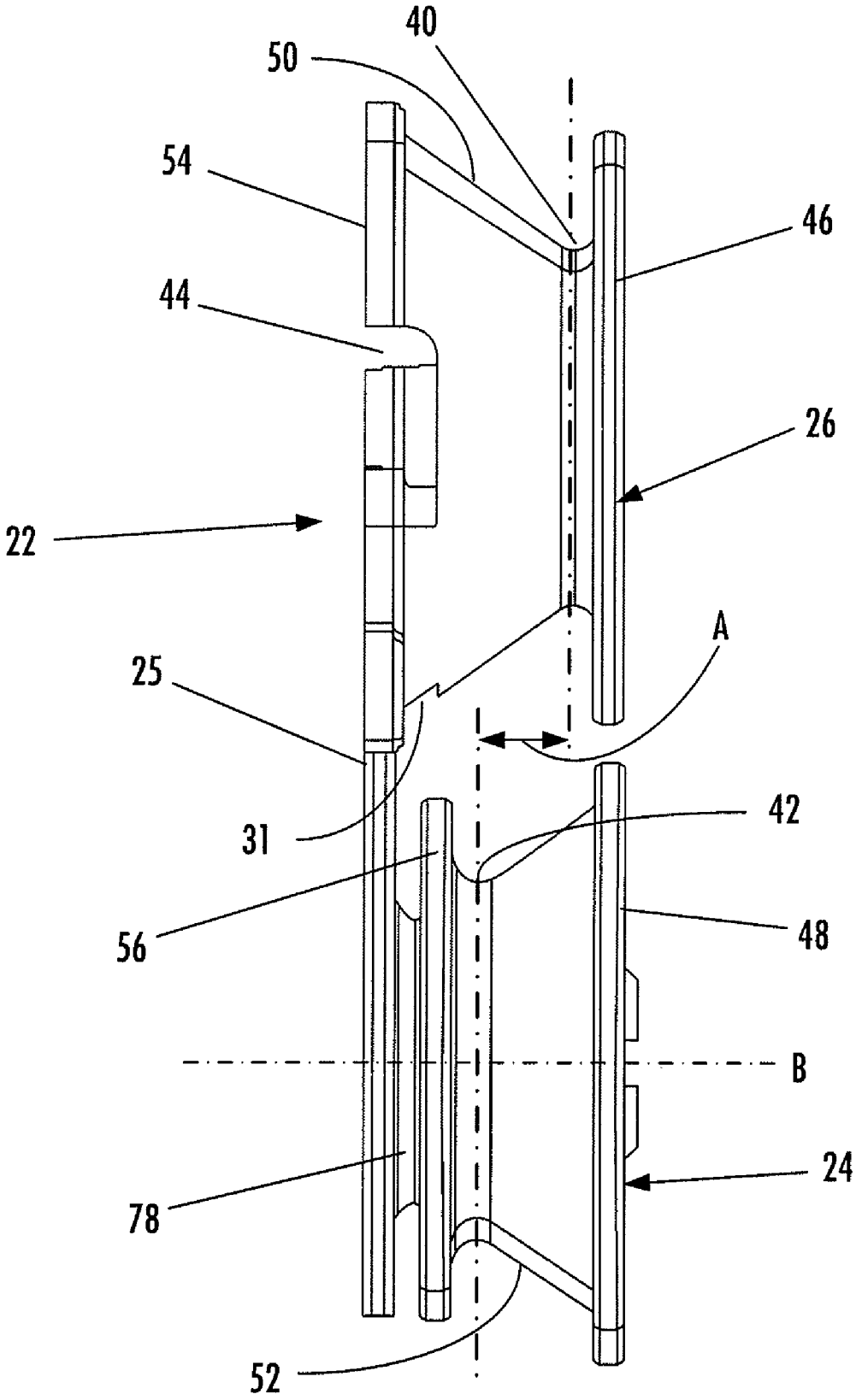
FIG. 4 depicts a side view of a guide member according to an embodiment of the present invention.
Figure 5:
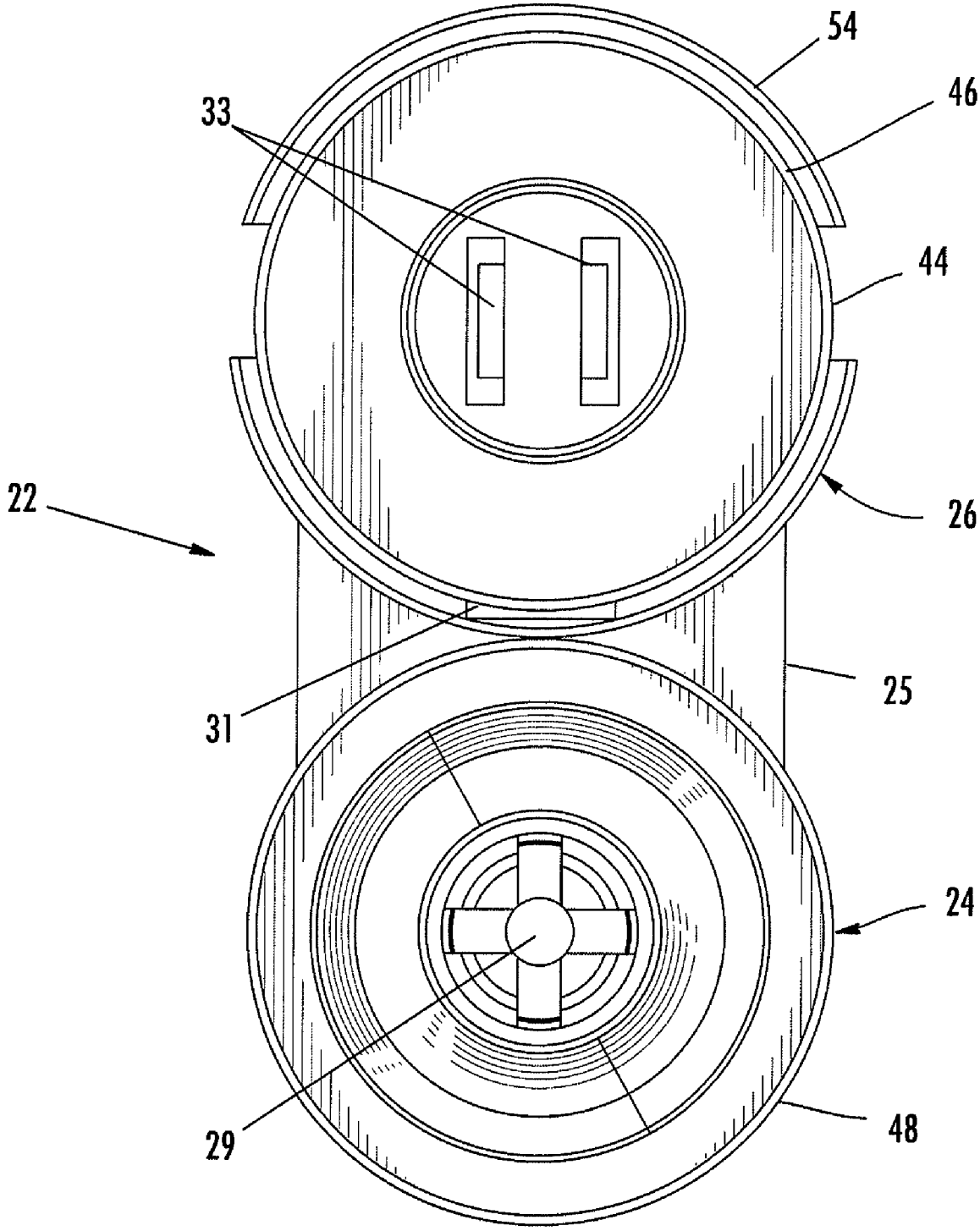
FIG. 5 shows a front view of the guide member shown in FIG. 4.
Figure 6:
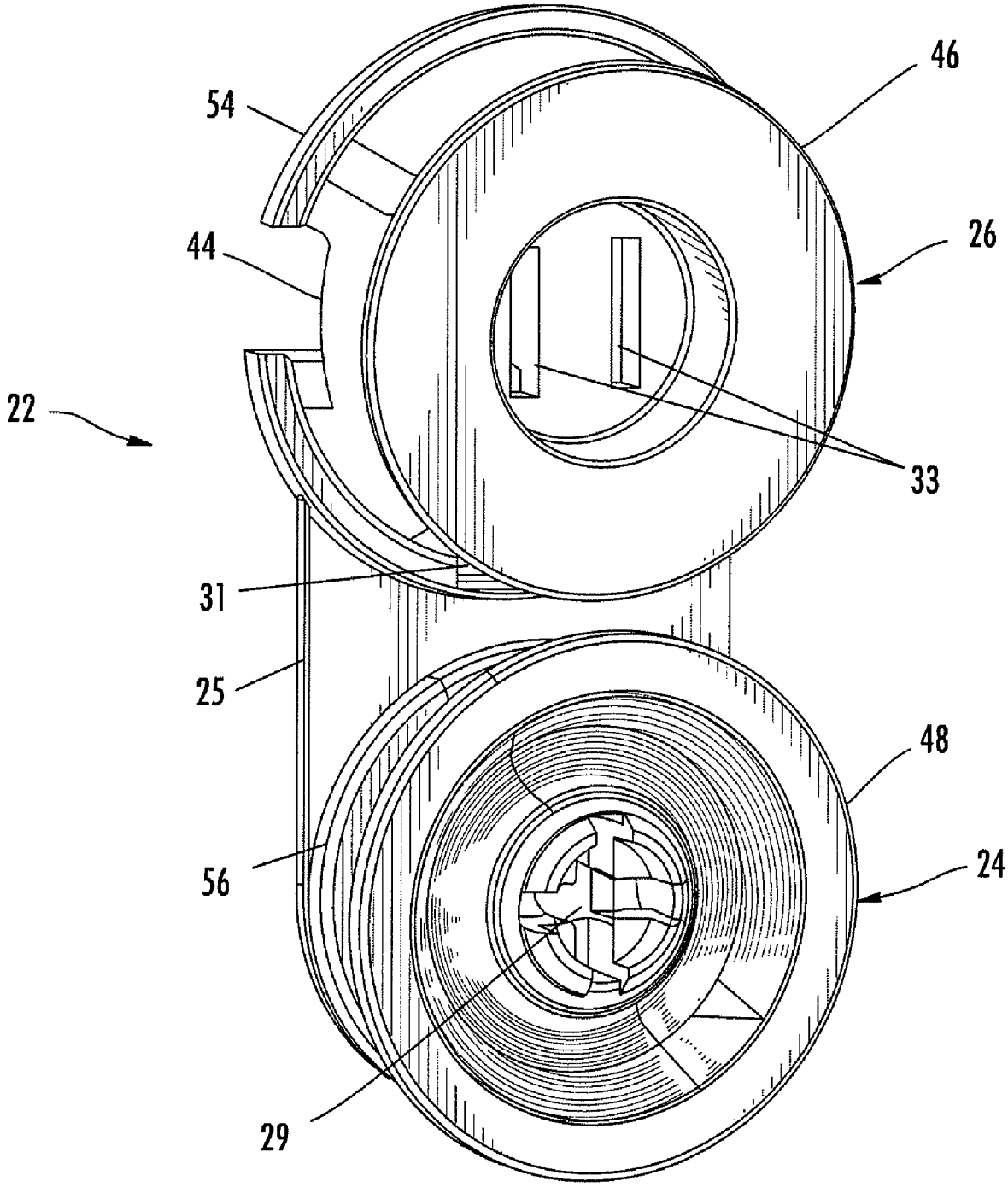
FIG. 6 is a perspective view of the guide member shown in FIG. 4.
Figure 9:
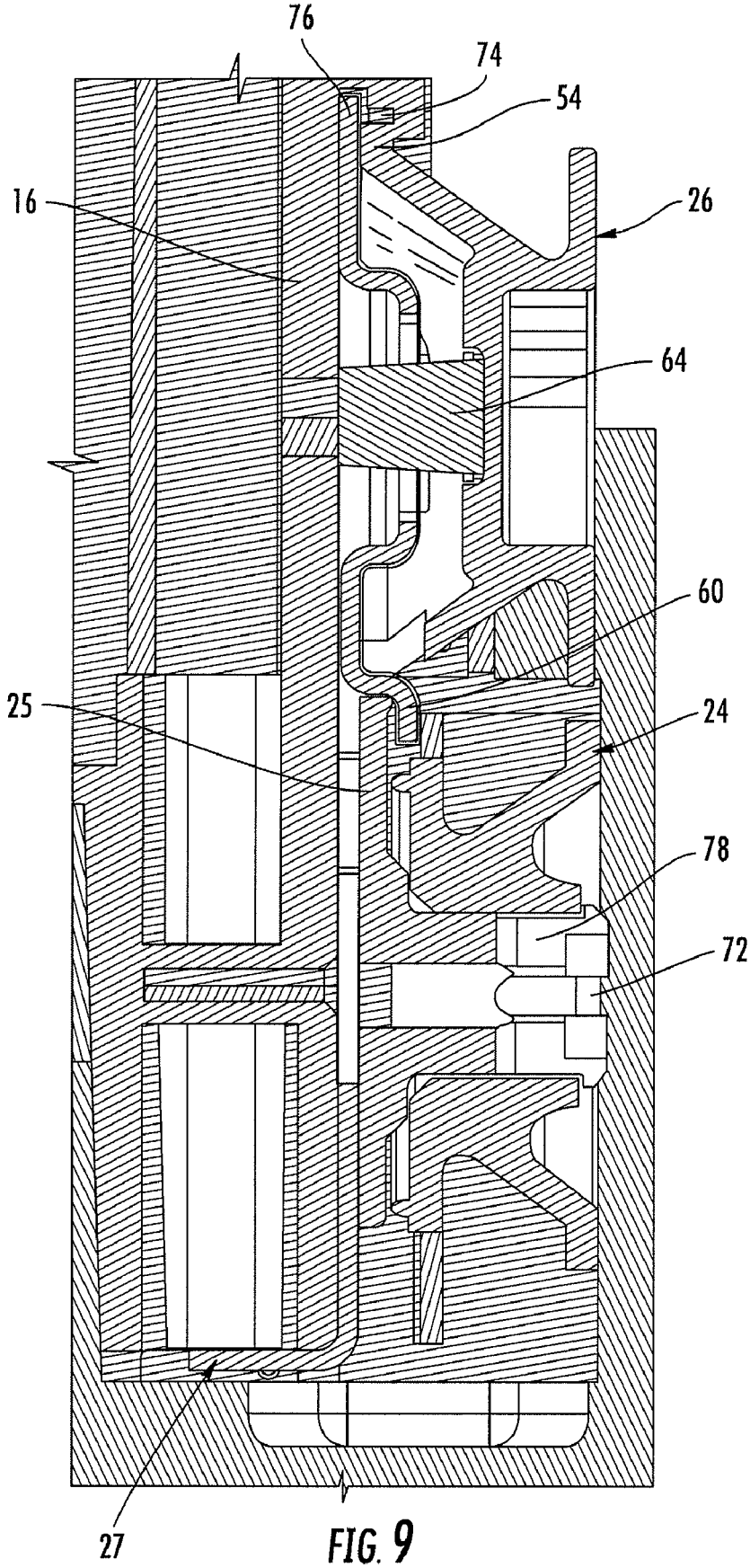
FIG. 9 is a cross-sectional view of a guide member secured to a body of a dishwasher according to an embodiment of the present invention.
Figure 10:
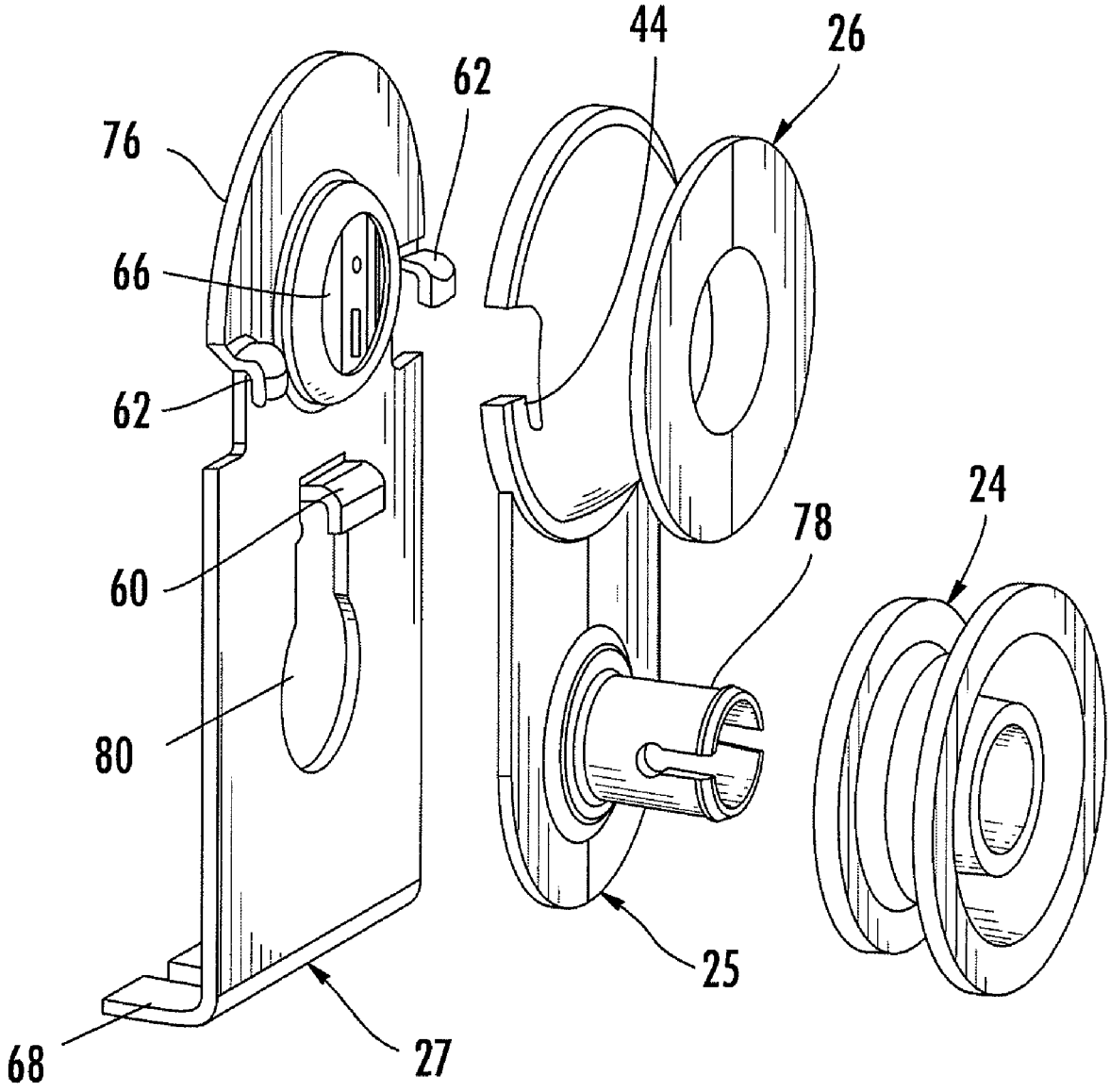
FIG. 10 is an exploded view of a guide member and a bracket according to one embodiment of the present invention.

FIGS. 1 and 2 also illustrate that the counterbalance assembly 12 includes a guide member 22 located proximate to the front of the dishwasher 10. The guide member 22 includes a rotatable pulley 24 and an arcuate member 26. The rotatable pulley 24 and the arcuate member 26 may be coupled together with a backing 25, as shown in FIGS. 4-6. FIGS. 9 and 10 show that the backing 25 may extend from the arcuate member 25 and include a coupling member 78 that extends outwardly from the backing to engage the pulley 24. The pulley 24 is rotatable about the coupling member 78. As shown in FIG. 5, the outer portions 46, 48 of the arcuate member 26 and pulley 24 may be generally circular in configuration. The arcuate member 26 may also include a frustroconical portion 50 extending between an inner portion 54 and the outer portion 46, while the pulley 24 generally includes a frustroconical portion 52 extending between an inner portion 56 and the outer portion 48, as shown, for example, in FIG. 4.

Figure 7:
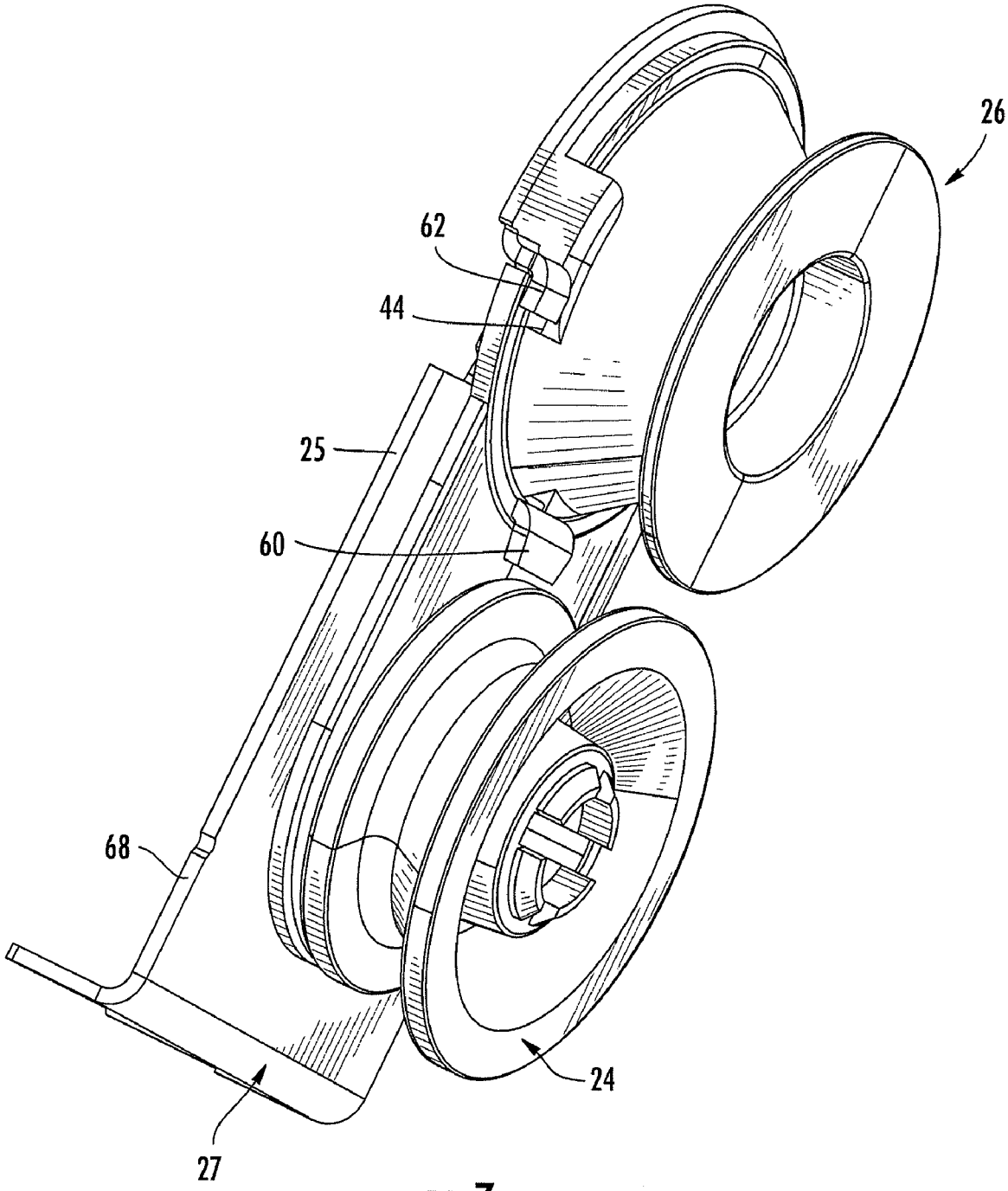
FIG. 7 is a perspective view of a guide member secured to a bracket according to one embodiment of the present invention.
Figure 8:
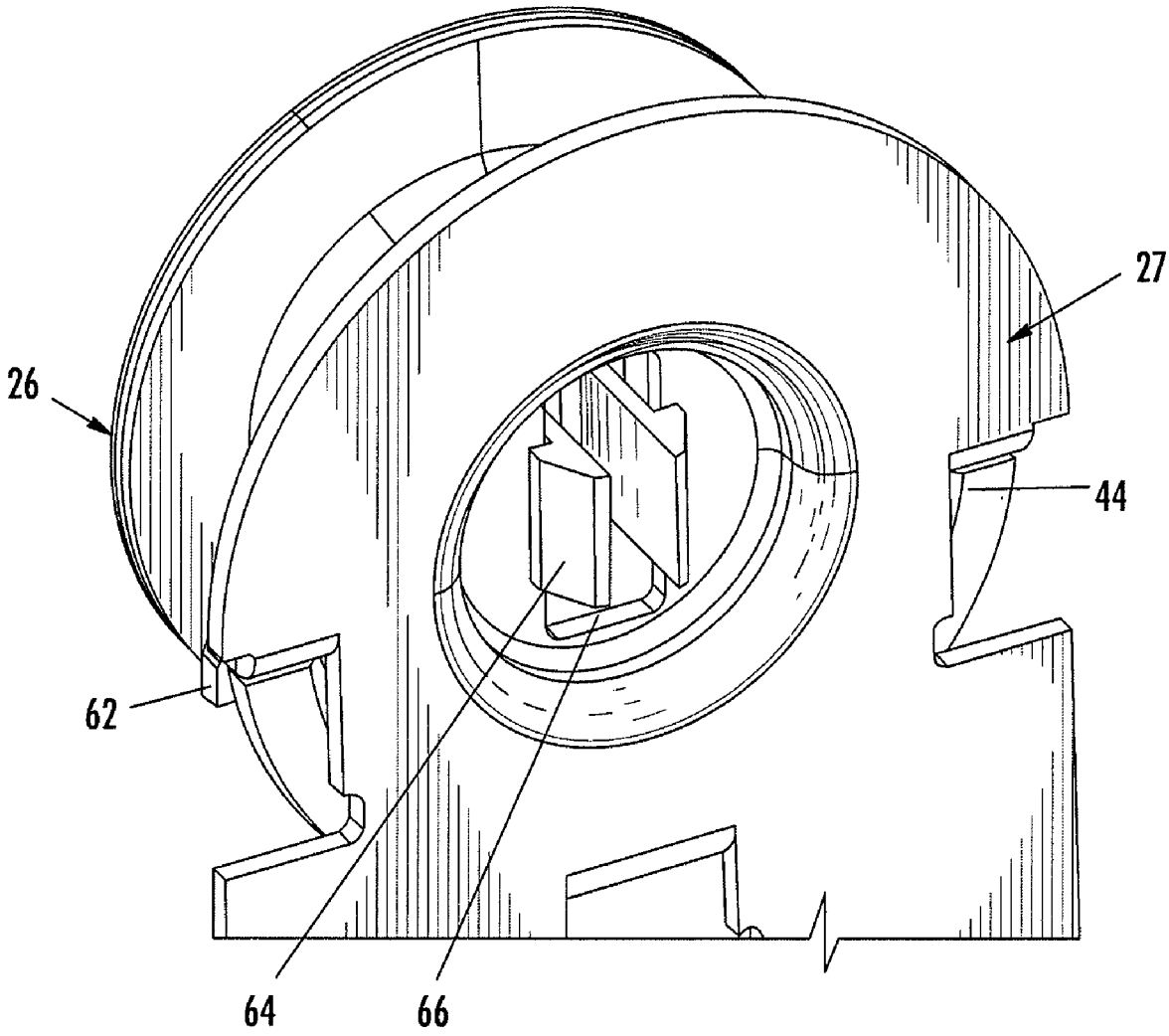
FIG. 8 is a partial perspective view of the guide member secured to the bracket shown in FIG. 7.

In one embodiment, the guide member 22 may be secured to the bracket 27, while the bracket 27 may be secured to the body 16 of the dishwasher, as shown in FIGS. 1, 2 and 7-9. In particular, a slot 31 is defined by a portion of the frustroconical portion 50 and inner portion 54 of the arcuate member 26, while slots 33 are defined by the frustroconical portion 50 so as to extend therethrough. A slot 44 is defined by the inner portion 54 and the frustroconical portion 50 of the arcuate member 26. As shown in FIG. 7, the slot 31 may engage with a clip 60 extending from the bracket 27. In addition, the bracket 27 may also include a pair of clips 62 that engage respective slots 44 of the arcuate member 26. As shown in FIG. 8, the arcuate member 26 may include a biasing clip 64 that biases outwardly to engage a hole 66 defined in the bracket 27. The biasing clip 64 could be disengaged from the bracket 27, for example, by accessing the clip 64 via slots 33 and biasing the ends of the clip 64 together. Furthermore, FIG. 7 demonstrates that the bracket 27 may include an L-shaped member 68 that is configured to extend both adjacent to the backing 25 and perpendicularly under the body 16 of the dishwasher 10. The bracket 27 may be configured to be secured to the body 16 using various techniques. For instance, at least a portion of the inner portion 54 of the arcuate member 26 and an arc-shaped member 76 of the bracket 27 could be configured to engage a slot 74 defined by the body 16, as shown in FIG. 9. The pulley 24 may also include a hole 72 sized and configured to receive a fastener therethrough, which secures the pulley 24 to the body 16, and also provides an axis of rotation (illustrated as axis B in FIG. 4) for the pulley 24. FIG. 10 demonstrates that a fastener may be configured to extend though each of the hole 72 in the pulley 24, the coupling member 78, a hole 80 defined in the bracket 27, and into the body 16.

In one embodiment, the arcuate member 26 of the guide member 22 is fixed, while the pulley 24 of the guide member 22 is rotatable. In addition, the arcuate member 26 and pulley 24 define respective guide tracks 40, 42, as shown in FIG. 4. The guide tracks 40, 42 are generally semi-circular in configuration and are sized and configured to receive the flexible element 20. The flexible element 20 is configured to extend in a serpentine manner about the arcuate member 26 and the lower pulley 24, within the guide tracks 40, 42. The arcuate member 26 provides friction with the flexible element 20 such that the door 14 can be maintained in any position between the fully opened and the fully closed positions. The rotatable lower pulley 24 guides the flexible element 20 and may be less prone to squealing (due to the rotating interaction with the flexible element) than, for example, instances in which the pulley or other lower member is fixed.

FIG. 4 illustrates an additional aspect of the guide member 22. In this regard, the guide track 40 of the fixed arcuate member 26 is laterally offset from the guide track 42 of the pulley 24, with respect to the axis B about which the pulley 24 rotates. The offset distance is designated as reference A in FIG. 4. As such, the flexible element 20 engages the guide track 40 of the fixed arcuate member 26 at a different lateral position (i.e., spaced further outward from the body 16 of the dishwasher 10) than the guide track 42 of the pulley 24. Thus, from the side view shown in FIG. 4, the flexible element 20 would extend obliquely between the pulley 24 and arcuate member 26. The offset between the pulley 24 and arcuate member 26 may allow the biasing member 18 to be disposed further inward under the body 16 of the dishwasher 10, while the hinge bracket 28 may be spaced laterally outward therefrom to clear the sides of the body 16.

It is understood that the exemplary guide member 22 shown in FIGS. 1-10 is not meant to be limiting and may be various sizes and configurations in additional aspects of the present invention. For example, the arcuate member 26 and pulley 24 may be independently secured to the body 16 such that the backing 25 is unnecessary. Similarly, different techniques may be employed to secure the pulley 24 and arcuate member 26 to the body 16, such as with fasteners, clips, rivets, adhesives, and the like. Moreover, the arcuate member 26 may be other configurations than circular, such as semi-circular, and still provide a semi-circular guide track 40 for the flexible element 20 to interact therewith. The pulley 24 and arcuate member 26 may be different sizes to accommodate different dishwashers 10 and flexible elements 20. For instance, the guide tracks 40, 42 may be other sizes and configurations depending on the size and configuration of the flexible element. Furthermore, the offset distance A may be varied in order to achieve a desired tension in the flexible element 20 between the pulley 24 and the arcuate member 26 for opening and closing the door 14 (e.g., increasing the offset distance A for a heavier door 14). In still other instances, the positions of the pulley 24 and the arcuate member 26 may be reversed, or the guide member 22 may be disposed and engaged with the dishwasher 10 such that the pulley 24 and arcuate member 26 are non-vertically oriented. Additionally, it may be desirable for certain applications to fix the pulley 24 and allow the arcuate member 26 to rotate, fix both the pulley 24 and arcuate member 26, or allow both the pulley 24 and arcuate member 26 to rotate.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwasher, comprising:

a door pivotably attached to a body and having a counterbalance assembly coupled therebetween for facilitating pivoting of the door, wherein the counterbalance assembly comprises:

a biasing member coupled to the body;

a flexible element coupled to the door and serially engaged with the biasing member; and a guide member coupled to the body and including a fixed arcuate member defining a first guide track, and a pulley rotatable about an axis and defining a second guide track, wherein the flexible element is at least partially wrapped about each of the fixed arcuate member and the pulley so as to serially engage the first and second guide tracks, wherein the first guide track of the fixed arcuate member is offset from the second guide track of the pulley along the axis thereof, and wherein the fixed arcuate member is offset laterally outward from the body along the axis of the pulley such that the second guide track of the pulley is positioned closer to the body than the first guide track of the fixed arcuate member.

2. The dishwasher of claim 1, wherein the flexible element extends obliquely between the first guide track of the fixed arcuate member and the second guide track of the pulley with respect to the body, the first and second guide tracks extending within different planes with respect to the body and disposed perpendicular to the axis of the pulley.

3. The dishwasher of claim 1, wherein the flexible element serially extends from the biasing member, about the second guide track of the pulley, about the first guide track of the fixed arcuate member, and to the door.

4. The dishwasher of claim 1, wherein the flexible element is configured to be wrapped about the first guide track of the fixed arcuate member and the second guide track of the pulley in a serpentine configuration.

5. The dishwasher of claim 1, further comprising a bracket secured to the body, wherein the fixed arcuate member and pulley are coupled to the bracket.

6. The dishwasher of claim 5, wherein the bracket comprises a plurality of clips configured to engage a plurality of respective slots defined by the fixed arcuate member.

7. The dishwasher of claim 5, wherein the fixed arcuate member comprises at least one clip configured to engage a hole defined by the bracket.

8. The dishwasher of claim 5, wherein the bracket is L-shaped and is configured to be positioned adjacent to the body along a pair of perpendicular surfaces.

9. The dishwasher of claim 1, further comprising a bracket attached to the body and comprising a plurality of holes defined thereby, wherein the biasing member is configured to engage a respective one of the plurality of holes.

10. The dishwasher of claim 1, wherein the biasing member is configured to extend from a relaxed position when the door is opened and to contract to the relaxed position when the door is closed.

11. The dishwasher of claim 1, wherein a length of the flexible element extending between the fixed arcuate member and the door is configured to shorten when the door is closed and lengthen when the door is opened.

12. A method for facilitating pivoting of a door with respect to a body of a dishwasher, the method comprising:

coupling a biasing member to the body;

serially engaging the biasing member with a flexible element;

coupling the flexible element to the door;

securing a guide member to the body, the guide member including a fixed arcuate member defining a first guide track and a pulley rotatable about an axis and defining a second guide track; and wrapping the flexible element at least partially about each of the fixed arcuate member and the pulley so as to serially engage the first and second guide tracks, wherein the first guide track of the fixed arcuate member is offset from the second guide track of the pulley along the axis thereof, and wherein the fixed arcuate member is offset laterally outward from the body along the axis of the pulley such that the second guide track of the pulley is positioned closer to the body than the first guide track of the fixed arcuate member.

13. The method of claim 12, wherein securing comprises securing the guide member to a bracket coupled to the body.

14. The method of claim 13, wherein securing comprises engaging a plurality of slots in the guide member with a plurality of clips extending from the bracket.

15. The method of claim 12, wherein wrapping comprises wrapping the flexible element about the first guide track of the fixed arcuate member and the second guide track of the pulley in a serpentine configuration.

16. The method of claim 12, wherein the flexible element serially extends from the biasing member, about the second guide track of the pulley, about the first guide track of the fixed arcuate member, and to the door.

17. A guide member assembly for facilitating pivoting of a door with respect to a body of a dishwasher and configured to be coupled to the body, the guide member comprising:

a fixed arcuate member defining a first guide track for receiving a flexible element;

a pulley rotatable about an axis and defining a second guide track for receiving the flexible element, wherein the pulley is coupled to the fixed arcuate member, and wherein the first guide track of the fixed arcuate member is offset from the second guide track of the pulley along the axis thereof, and wherein the fixed arcuate member is configured to be offset laterally outward from the body along the axis of the pulley when the guide member is coupled to the body such that the second guide track of the pulley is positioned closer to the body than the first guide track of the fixed arcuate member.

* * * * *